United States Patent [19]

Albrecht

[11] 4,271,614

[45] Jun. 9, 1981

[54] FLOATING SOIL FRACTURE TOOL

[75] Inventor: Allan J. Albrecht, Rothschild, Wis.

[73] Assignee: J. I. Case Company, Racine, Wis.

[21] Appl. No.: 86,811

[22] Filed: Oct. 22, 1979

[51] Int. Cl.[3] ..... E02F 9/28

[52] U.S. Cl. ..... 37/103; 37/141 T

[58] Field of Search ..... 37/103, 117.5, 141 R, 37/141 T, 142 R, 142 A, 118, DIG. 3, DIG. 12, 2 R; 299/91; 414/490, 693

[56] References Cited

U.S. PATENT DOCUMENTS

| | | | |
|---|---|---|---|
| 1,919,075 | 7/1933 | Rasmussen | 37/141 T |
| 1,919,075 | 7/1933 | Rasmussen | 37/2 R |
| 3,027,027 | 3/1962 | Bles | 37/141 T |
| 3,084,817 | 4/1963 | Lovrenich | 37/103 |
| 3,896,569 | 7/1975 | Thompson | 37/141 T |
| 4,038,766 | 8/1977 | Felstet | 37/141 T |

FOREIGN PATENT DOCUMENTS

| | | | |
|---|---|---|---|
| 2811681 | 9/1979 | Fed. Rep. of Germany | 37/141 T |
| 544984 | 5/1942 | United Kingdom | 37/103 |
| 638044 | 5/1950 | United Kingdom | 37/141 T |
| 1356808 | 6/1974 | United Kingdom | 37/103 |
| 322466 | 2/1971 | U.S.S.R. | 37/141 T |
| 608887 | 5/1978 | U.S.S.R. | 37/103 |

*Primary Examiner*—E. H. Eickholt

*Attorney, Agent, or Firm*—Dressler, Goldsmith, Shore, Sutker & Milnamow, Ltd.

[57] ABSTRACT

A tool for fracturing soil to be excavated. A blade is pivotally attached to the scoop or bucket of an excavating machine. The axis of rotation of the blade is in advance of the leading edge of the blade relative to the direction of digging. The force of digging aligns the blade in the soil to be removed such that the line of force is directed along the axis of the blade. In another variation, teeth-like soil penetrating devices are added to the blade. The teeth may be individually pivoted relative to the blade in which case the blade is fixed in position. The axis of rotation of each tooth is ahead of the center of gravity of the tooth relative to the direction of digging. In another variation the pivotally mounted blade is locked in position to optimize the cutting force used to fracture the soil. The fracturing tool may also be used separately from the associated bucket or scoop. In this embodiment it is used as a rake or a device to break up clumps of soil or other frozen material.

5 Claims, 4 Drawing Figures

FLOATING SOIL FRACTURE TOOL

TECHNICAL FIELD

Apparatus for fracturing the soil in advance of an excavation scoop or bucket. In particular, a device for attachment to the scoop of an excavator to break up the soil in advance of the scoop.

BACKGROUND OF THE INVENTION

Broadly speaking excavation cranes or excavators can be separated into three basic classes: a trencher; a shovel; and a skimmer. Each includes a segmented boom. The boom is constructed either with a single pivot support for a swinging shovel (as in a trencher or shovel) or in the form of two rails set close together on which runs a wheeled carriage with a fixed shovel or skimmer.

In the skimmer a fixed shovel on a wheeled carriage is used to skim a load of soil off the ground level such as piled material for loading into trucks. When working as a digging shovel or excavator, the running carriage is replaced by an arm, pivoted to some point midway along the boom, and carrying the shovel at its lower end. The excavator is driven, with the boom raised, to the earth bank on which it is required to operate, until the shovel hanging at the end of its arm, is in a position to scoop up its load. The operating mechanism pulls the shovel up forwards and upwards in an arc. Steel cutting teeth set on the edge of a shovel then cut their way into the bank until the shovel is filled. The shovel is then swung over the loading truck and emptied as the case may be.

The trencher works on a similar principle, but in this case the shovel arm is pivoted at a point about one-third from one end, to the top of the boom with the shovel opening and the cutting teeth facing the operator. The trencher excavator is driven into position at the end of the trench. By means of the boom operating mechanism, it is pulled so that it swings the shovel away from the operator. The boom is then lowered until the shovel cutting teeth are in correct position; then it is pulled towards the operator causing it to describe an arc at the end of its arm and to dig downwards into the ground.

The principal point being in each of these cases is that the cutting teeth or digging edge of the bucket or scoop is driven in a fixed circle. Consequently, the cutting teeth or digging edge can be angled to an optimum position to maximize the soil fracturing effect thereby optimizing the digging effect of the shovel or scoop.

Excavators are not restricted to one axis of rotation. That is, the bucket or scoop may be rotated about more than one horizontal axis at the same time. In particular, most excavator buckets or scoops usually have at least two, if not three, horizontal axes of rotation. Consequently, the leading edge or digging edge of the bucket or scoop cannot be made to bite into the ground to be excavated at the optimum angle of attack. One expedient to resolve this problem is to incorporate soil penetrating devices on the leading edge of the bucket such that the angle of attack is broadened thereby reducing the reaction forces applied to the bucket or scoop as it excavates soil.

In addition, the orientation of the bucket or scoop has a significant effect on the force needed to remove or break up the soil.

It is common experience to observe a trencher or shovel excavating ground and see the forward portion or rearward portion of the machine base lift off the ground. This is in response to the reaction forces of the soil being applied to the bucket or scoop and along the boom to the base of the crane. This is one indication that the leading edge or the digging edge of the bucket or scoop is not aligned in its optimal direction relative to the soil to be removed.

Preferably, the orientation of the leading edge of the scoop or bucket should be parallel to and coincident with the line of maximum net force exerted by the scoop on the embankment being penetrated. Such a design would also result in evenly distributed wear on the surfaces of the excavation scoop. Furthermore, it would tend to eliminate the bending stress at the leading edge or lip of the scoop when maximum digging forces are imposed thereon. These facts were recognized by Thompson (U.S. Pat. No. 3,896,569); however, it was believed that proper tooth orientation could be factored into design and that fixed, non-pivoting teeth were satisfactory. The problem experienced in using excavators whose buckets may be pivoted about two or more parallel axis of rotation was not addressed.

It is not uncommon that excavation is complicated by poor soil conditions. Often the ground to be worked is frozen, rocky or extremely well packed or dense. In such instances, some means must be provided to break up the hardened earthen material before excavation. Rasmussen (U.S. Pat. No. 1,919,075) described a grubbing tool for tree removal prior to soil cultivation. Although movable teeth are used no suggestion is made that the teeth serve any purpose other than entrainment of roots and other tangled debris. It operated much like a "rake."

SUMMARY OF THE INVENTION

In accordance with the present invention a floating or adjustable cutting edge is provided for the bucket or scoop of an excavating implement or apparatus. Modern excavating equipment normally employs more than one boom or implement arm. In particular, a set of articulated arms are joined together with hydraulic rams positioning the arms relative to each other. The net result being that the excavating tool, usually a bucket or scoop, is not positioned optimally in all circumstances for the removal of soil. For example, it is difficult to excavate frozen rocky or hardened earthen material.

By providing a cutting blade pivoted at the digging edge of the bucket or scoop the blade in effect "floats" relative to the surface of the soil to be removed. Furthermore, the full digging force is used to drive a wedge into the soil. The result of a wedge being forced into hardened soil is to fracture that soil. The fractured or broken soil can then be easily removed by the bucket or scoop.

In one embodiment of the invention, a series of teeth are placed ahead of the blade portion of the fracturing tool. Each tooth serves in itself as a wedge to fracture the soil in advance of the blade portion. The tooth serves to concentrate the digging force along the soil penetration point and thereby insures that the fracturing tool obtains a bite or grip on the soil.

In another embodiment of the invention, the blade portion of the fracturing tool is fixed relative to the bucket or scoop and each individual tooth is made to pivot about an axis on the blade. In a final embodiment of the invention, provision is made to lock the pivotally attached blade portion of the fracturing tool at a selected angle. Depending on the character of the soil to be removed, the operator can select the optimal angle of attack for the blade portion of the fracturing tool and then lock that angle of attack into position on the bucket or scoop. This embodiment also uses individually pivotally attached teeth. Thus, combination of the adjustable blade and the pivoting teeth ensures that the minimum force necessary is applied to the soil to fracture it in advance of the bucket or scoop.

It should be realized that the fracturing tool may be used separately from the bucket or scoop. In such a case the fracturing tool will be attached to the digging arm of the excavating tool. It would serve as a device to break up soil in advance of other excavating equipment. For example, it could serve as a ice breaking tool to split frozen water into chunks for easy removal. Similarly, frozen coal presents a frequent problem that has been known to cause power outages at utilities in the winter. The fracturing tool could be used to break up the coal so it can be moved into the power plant.

DETAILED DESCRIPTION OF THE INVENTION

Figure 1:
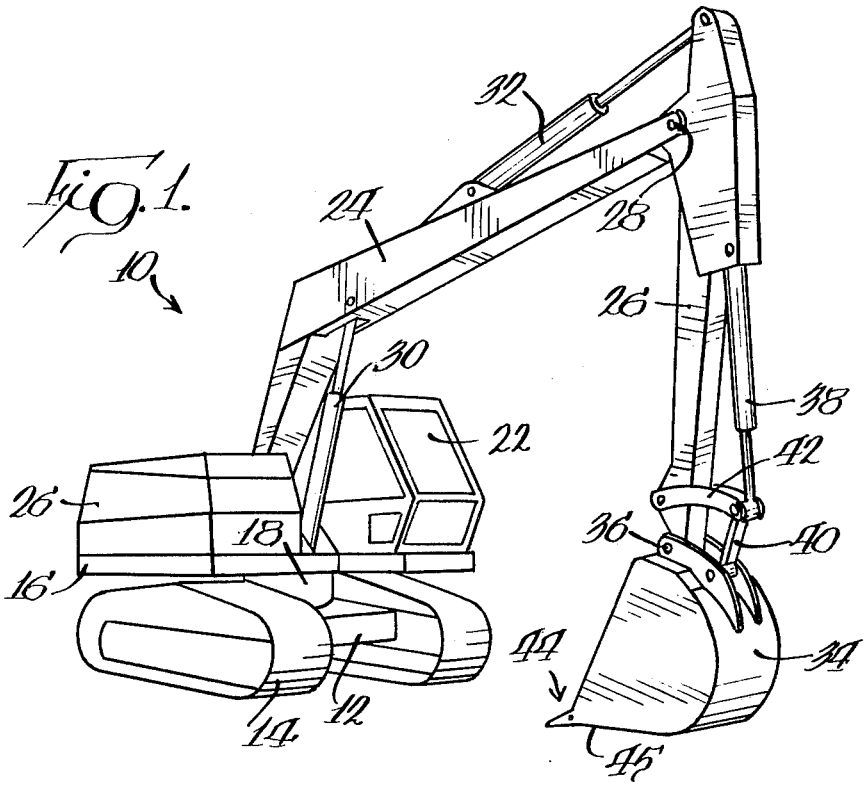
FIG. 1 is a pictorial representation of soil fracturing tool installed in a crawler mounted excavator.

While this invention is susceptible to embodiment in many different forms, there is shown in the drawings and will herein be described in detail embodiments with the understanding that the present disclosure is to be considered as an exemplification of the principles of the invention and is not intended to limit the invention to the particular embodiment illustrated.

FIG. 1 shows what is commonly referred to as a hydraulic excavator 10. It includes an undercarriage 12 having a pair of tracks 14 for traversing rough and uneven terrain. The upper structure 16 is pivotally carried about a vertical axis on the undercarriage 12 by a swing bearing 18. A power unit 20 is mounted on the upper structure 16 as is a cab 22 for an operator to manipulate the controls. The power unit 20 is a gasoline or diesel engine which operates various hydraulic cylinders and hydraulic motors which operate the hydraulic excavator 10 and the other apparatus attached to it. A boom 24 is pivotally secured to the upper structure 16 about a horizontal axis transverse to the longitudinal axis of the excavator. The outer end of the boom 24 pivotally carries a dipper stick 26 which is pivoted thereto about a pivot point 28.

A hydraulic lift cylinder 30 is pivotally connected at one end to the overhead assembly 16 and its other end to the boom 24. The lift cylinder 30 pivots the boom 24 through a vertical plane about the horizontal pivot (not shown) of the boom on the upper structure 16. A hydraulic crowd cylinder 32 is pivotally interconnected at one end to the boom 24 and its other end to the dipper stick 26. The crowd cylinder 32 pivots the dipper stick 26 in a vertical plane about the pivot connection 28 between the boom 24 and the dipper stick 26.

The excavating tool or implement 34 is pivotally joined to the dipper stick 26. It is positioned by a hydraulic cylinder 38 pivotally interconnected at one end to the dipper stick 26 and to the bucket or scoop 34 at its other end. Forces are transmitted to the bucket or scoop 34 from the hydraulic ram 38 via a linkage assembly. This linkage assembly includes a pivotally mounted operating link 40 and a connecting link 42. The soil fracturing tool 44 is located at the digging end 45 or lip portion of the bucket or scoop 34.

Figure 3:
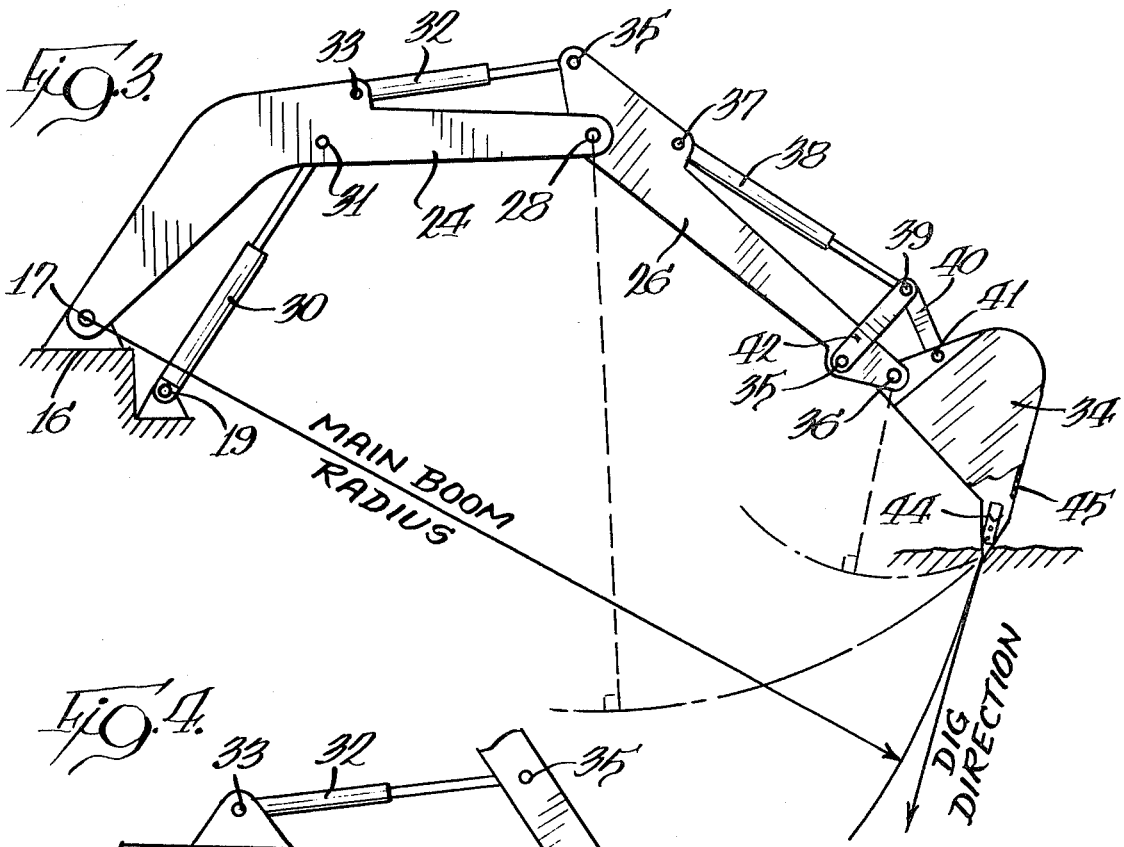
FIG. 3 is a schematic representation of pivoting points of an articulated working arm.

FIG. 3 illustrates the major pivoting arms and pivot points of the components shown in FIG. 1. Briefly recapitulating, the boom 24 is pivoted to the upper structure 16 at a pivot point 17. The boom is manipulated by a hydraulic cylinder 30 pivotally connected at 31 to the boom 24 at one end and pivotally connected at 19 to the upper structure 16 at the other end. Similarly, the dipper stick 26 is pivoted at 28 to the boom 24. The dipper stick 26 is manipulated by a hydraulic cylinder 32 pivotally connected at 35 to the dipper stick 26 and pivotally connected at 33 to the boom 24. Finally the scoop 34 is pivotally connected at 36 to the dipper stick 26.

The scoop is rotated by a hydraulic cylinder 38 interposed between and pivotally connected at 37 to the dipper stick 26 and pivotally connected at 39 to the scoop 34 via linkages 40 and 42. These links are also pivotally connected at 35 and 41 to the dipper stick and scoop respectively. The soil fracturing tool 44 is located at the digging end 45 of the bucket or scoop 34.

The articulated linking of the bucket or scoop to the upper structure 16 effectively provides for rotating the digging end 45 of the bucket or scoop 34 about three axes of rotation: the pivot point 17 for the boom 24; the pivot point 28 for the dipper stick 26; and the pivot point 36 for the bucket or scoop 34. Since the operator may manipulate his controls to move the boom 24 the dipper stick 26 and the bucket or scoop 34 simultaneously, there is effectively created an infinite number of positions or centers of rotation for the digging end 45 of the bucket or scoop 34. Therefore, the direction of soil penetration or the direction of digging will not necessarily coincide with, or be parallel to, a line drawn tangentially to the lip 45 of the bucket or scoop 34.

Figure 4:
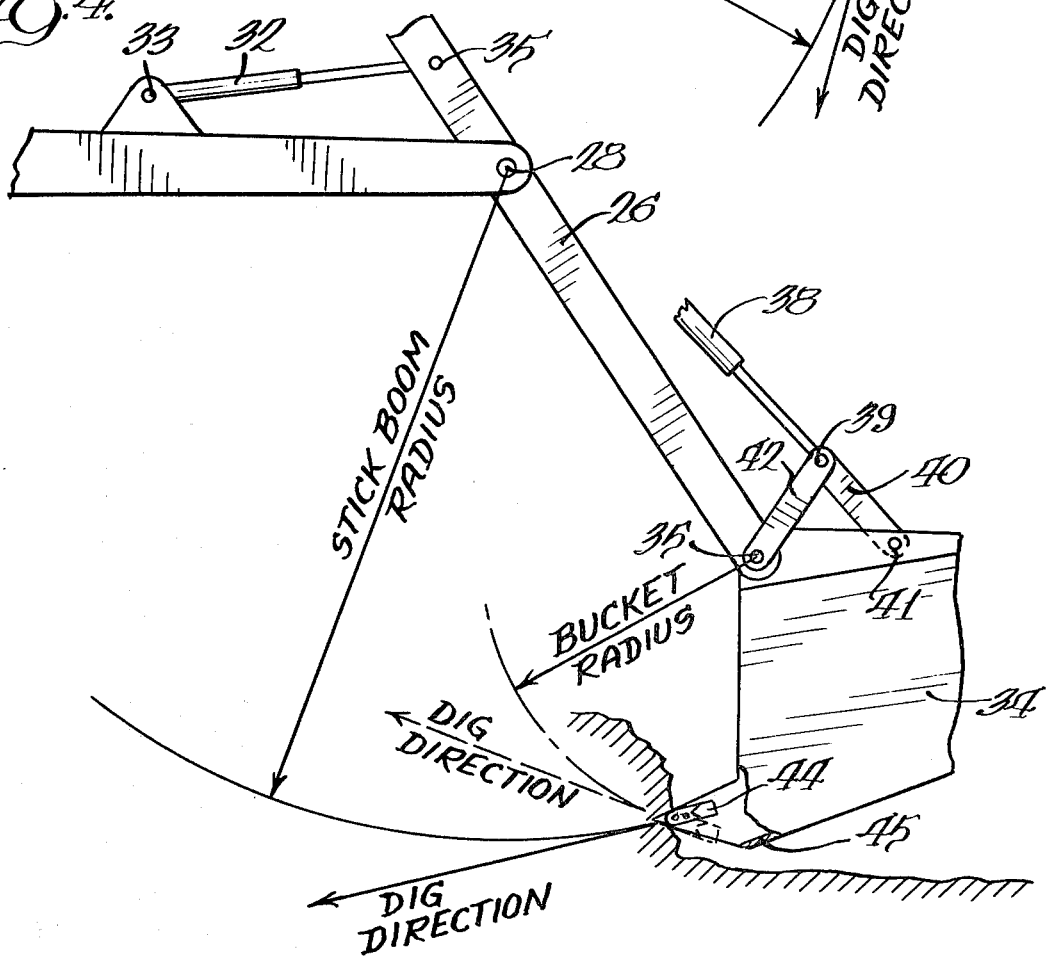
FIG. 4 is a partial enlarged view of the fracturing tool shown in FIG. 3 illustrating the major force components.

Since the lip of the bucket or scoop ordinarily takes the first bite into the soil, the angle of attack of the lip 45 relative to the point of penetration governs the balance of forces on the lip resulting from the digging force and the reaction force of the soil. Referring to FIG. 4, the force on the soil can have at least three distinct values depending on which cylinder is pressurized; movement can be induced in at least three directions depending on which cylinder is moved to manipulate the bucket or scoop.

From basic mechanics it is understood that the force to cause a wedge-like device to penetrate into the workpiece is minimal if center line or axis of the device coincides or is parallel to the line of force applied to it. If the center line of the device is displaced from a line perpendicular to the material to be penetrated, the line of force applied to the device may be resolved into two perpendicular components. One component of force is directed towards driving the device into the surface. The other is directed towards displacing the device laterally from its point of intersection with that surface. This latter force does not aid penetration and is considered "wasted. " Simply stated, the lowest or minimum force needed to fracture a surface by using a device exists when the line of force applied along the axis of that device is aligned perpendicularly to the surface to be penetrated.

Recalling the familiar analogy of splitting wood with a wedge, it should be obvious that a greater force is required to hold the wedge in position if that wedge is not aligned with the direction of the line of force directing the wedge into the wood. Any deviation between the axis of the wedge and the axis of force results in a component of that force being directed to displace the wedge relative to the point of intersection of the wedge with the surface. This displacement force corresponds to, and is in the opposite direction to, the reaction force from the soil. This results in a force component being applied to articulated arms which causes the upper structure 16 to be displaced or pivoted relative to its wheels or tracks.

Figure 2:
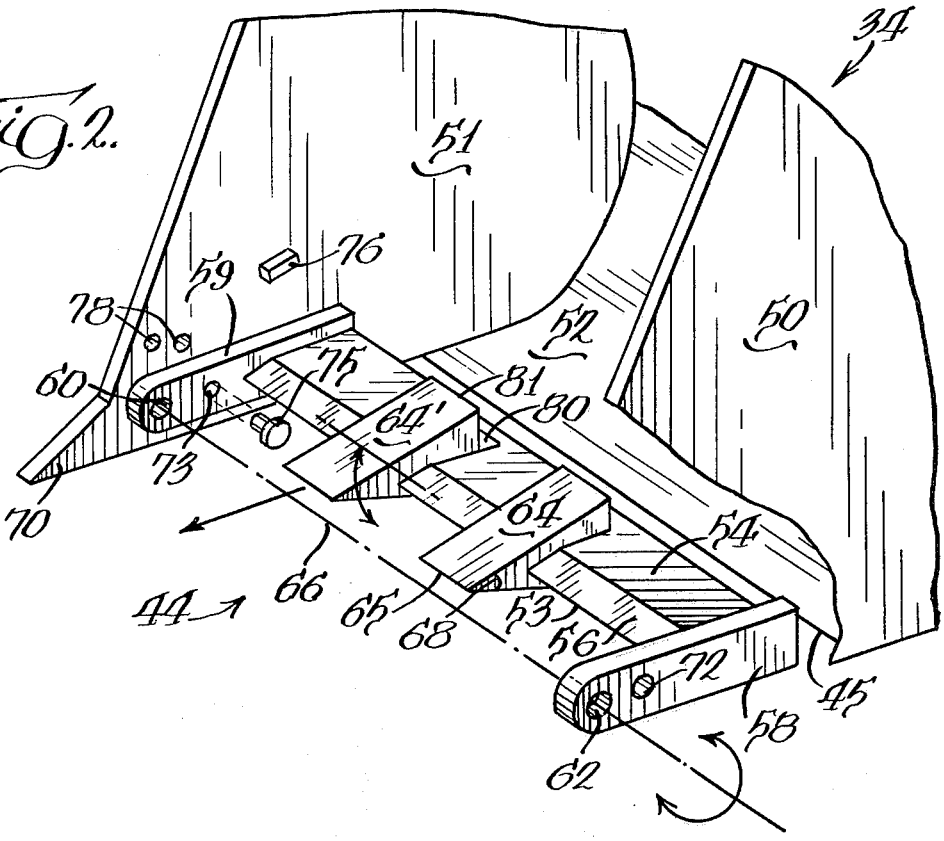
FIG. 2 is an enlarged pictorial representation of the fracturing tool installed within the scoop of the vehicle illustrated in FIG. 1.

FIG. 2 illustrates the mounting of the soil fracturing tool 44 in the bucket 34 of the machine shown in FIG. 1. This device circumvents the problems just discussed. In particular, the tool is interposed between the side walls 50 and 51 and in advance of the digging end or lip 45 of the bucket pan 52. The main portion of the fractured tool includes a rectangular bar 54. The leading edge 53 of the bar 54 is ground to a pointed or wedge shaped surface 56 thereby providing a structure analogous to a blade. This blade 54 is interposed between two lugs 58 and 59. One end of each lug is joined to the blade while the other end includes an aperture 60 and 62 for pivotally attaching the blade 54 to the side walls 50 and 51 of the bucket or scoop. The two pivot points 60 and 62 define the pivot axis 66 of the blade 54. It is this feature (i.e., pivot axis 66 in advance of leading edge 53, relative to the direction of digging) that insures that the blade 54 becomes self-adjusting or "floating" relative to the angle of attack (i.e., angle between the bucket lip 45 and a perpendicular line to the surface of the soil). It also insures that the maximum forces are applied in the direction of the ground to be excavated. This optimization of forces is especially important for small angles of attack.

Also included on the blade portion 54 are a series of teeth or "soil penetration devices" 64. The leading edge 65 of each soil penetration device 64 is located between the axis of rotation 66 of the blade 54 and the leading edge 53 of the blade 54. The digging edge or lip portion 45 of the bucket or scoop 34 is located behind (relative to the direction of digging) the leading edge 53 of the blade 54 or the leading edge 65 of the soil penetrating devices 64. This insures that the digging force of the hydraulic excavator is applied through the soil penetrating devices or blade of the fracturing tool 44 and not through the bucket pan 52. Thus, the fracturing tool serves to break up and displace the soil while the bucket assembly 34 serves to provide a container for the soil scooped up.

It should be noted that the lugs 58 and 59 of the fracturing tool 44 and the side walls 50 and 51 of the bucket or scoop 34 are very thin relative to the width of the bucket. Essentially each lug and side wall represents a "knife edge" compared to the broad leading edge 53 of the fracturing tool 44 and the lip 45 of the bucket 34. For this reason a fixed pointed edge 70 on the leading edge of the bucket sidewalls is adequate. The pointed edge 70 easily cuts into the soil regardless of angle of attack of the bucket lip 45 and without affecting the rotation of the fracturing tool 44.

Depending on the application under consideration, the toothed portion of the fracturing tool may not be necessary. In that case, the only blade portion 54 would be used. The teeth or soil penetrating devices 64 may be made removable from the blade portion of the fracturing tool or a separate "toothless blade" used in its place. Similarly, it is also envisioned that in certain applications may be preferable to pivot each soil penetrating device or tooth 64' individually while the blade portion 54 of the soil fracturing tool 44 is rigidly attached to the bucket or scoop 34. A threaded fastener or pin 75 passing through corresponding apertures (not shown) in the side walls 50 and 51 and apertures 72 and 73 in the lugs 58 and 60 can be used as a releasable locking means to hold the blade 54 fixed relative to the scoop 34.

There may be applications such as scraping or braking up of ice chunks where the soil fracturing tool 44 is used independently of the bucket or scoop. In such cases a frame (not shown) approximate in shape to the scoop sidewalls 50 and 51, would join the fracturing tool 44 to the dipper stick 26 assembly and associated linkage. In still another application, provision could be made for locking the blade 54 portion of the soil fracturing tool at a given angle of attack relative to the soil. A series of apertures 78 in the bucket sidewalls 50 and 51 would work in conjunction with the releasable locking means previously described. This mode of operation, in combination with individually pivoting teeth or fixed teeth, 64 would provide for optimum soil removal consistent with site conditions.

Since the force of digging is applied to soil via the blade or toothed portion of the fracturing tool 44 and since the blade 54 or teeth 64, pivot about an axis ahead of the leading edges of the blade 54 or teeth 64 (relative to the direction of digging), it necessarily follows that the center of gravity or the center of mass of the blade or teeth is located behind the corresponding axis of rotation (66 in the case of the blade 54). For this reason stops 76 may be necessary to preclude the blade "tipping over" its axis of rotation 66 while the bucket 34 is swung for unloading. In the case of the teeth, the complementary cutouts 80 on the blade 54 cooperating with the rear edges 81 of the pivoting tooth 64' may be used to define limits of rotation.

Finally, it should be noted that the fracturing tool 44, although shown free floating, may be controlled by various linkages or positioned by motors, springs, or vibrators. The motivation to select this option would depend upon site conditions and the particular task to be accomplished.

From the foregoing, it will be observed that numerous variations and modifications may be effected without departing from the true spirit and scope of the novel concept of the invention. It is to be understood that no limitation with respect to the specific apparatus illustrated herein is intended or should be inferred. While the invention has been described as embodied in a crawler hydraulic excavator, the soil fracturing tool may be just as easily installed in a bucket loader or other off road machines. It is of course intended to cover by the appended claims all such modifications as fall within the scope of the claims.

What is claimed is as follows:

1. A soil fracture tool comprising:

(a) a bucket scoop for excavating soil, said scoop being pivoted about at least two parallel axes of rotation; and (b) blade means, adapted to be received by said scoop along the digging edge of said scoop, for wedging into said soil to be excavated, said blade means being pivotally attached to said scoop, the pivot axis of said blade means being positioned in advance of the leading edge of said blade means relative to the digging direction of said scoop, the rotation of said scoop in soil having the effect of aligning said blade means in the general direction of digging whereby said scoop fractures said soil with the minimum necessary digging force, said blade means generally aligning tangentially to a circle whose center is at the axis of rotation of said scoop.

2. The soil fracture tool defined in claim 1, wherein said blade means includes a toothed means for wedging into the soil to be excavated, said toothed means being fixedly attached to said blade means, the leading edge of said toothed means projecting in the direction of said blade means and extending ahead of said blade means in the general direction of digging of said scoop whereby said toothed means bites into and fractures said soil in advance of said blade means.

3. The soil fracture tool defined in claim 1, wherein said blade means includes lug means, at both ends of said blade means, for pivotally joining said blade means to said scoop.

4. The soil fracture tool defined in claim 1, wherein said blade means includes pintle means for hinging said blade means to said scoop, said pintle means pivoting said blade means relative to said scoop.

5. The soil fracture tool as defined in claim 1, wherein said blade means is pivotally attached to said scoop.

* * * * *